US006402942B2

(12) United States Patent
Cardwell et al.

(10) Patent No.: US 6,402,942 B2
(45) Date of Patent: Jun. 11, 2002

(54) CATCH BASIN CURB INLET FILTER ASSEMBLY

(76) Inventors: Troy Cardwell, 29377 Airport Rd.; Casey Cardwell, 4473 Hilton Dr., both of Eugene, OR (US) 97402; Cory Cardwell, 1635 Crescent Ave., Eugene, OR (US) 97408

( * ) Notice: Subject to any disclaimer, the term of this patent is extended or adjusted under 35 U.S.C. 154(b) by 0 days.

(21) Appl. No.: 09/799,774

(22) Filed: Mar. 5, 2001

Related U.S. Application Data

(60) Provisional application No. 60/188,286, filed on Mar. 7, 2000.

(51) Int. Cl.[7] ..... B01D 29/05; B01D 35/02

(52) U.S. Cl. ..... 210/155; 210/163; 210/254; 210/434; 210/489; 404/4

(58) Field of Search ..... 210/155, 162, 210/163, 164, 170, 259, 434, 474, 489; 404/4, 5

(56) References Cited

U.S. PATENT DOCUMENTS 783,556 A * 2/1905 Van Buskirk ..... 210/163
1,711,678 A * 5/1929 Egan ..... 210/163
4,732,675 A * 3/1988 Bodolato et al. ..... 210/489
5,372,714 A 12/1994 Logue, Jr.
5,375,940 A * 12/1994 Kobayashi ..... 404/4
5,405,539 A * 4/1995 Schreider ..... 210/163
5,575,925 A 11/1996 Logue, Jr.
5,632,888 A * 5/1997 Chinn et al. ..... 210/163
5,733,445 A 3/1998 Fanelli
5,954,952 A * 9/1999 Strauser, Jr. ..... 210/164
6,015,489 A 1/2000 Allen et al.

OTHER PUBLICATIONS

Complete Environmental Products Inc., "Environmental Containment and Spill Response Products", Cover page & pp. 18 & 19; Date of Publication Unknown.

* cited by examiner

*Primary Examiner*—Christopher Upton
(74) *Attorney, Agent, or Firm*—Robert E. Howard

(57) ABSTRACT

A catch basin curb inlet filter assembly for preventing debris from being swept into the catch basin by rainwater. The filter assembly has first and second outer filters, an inner filter located between said first and second outer filters adjacent the lower longitudinal edges thereof, and a rigid rib member located between the first and second outer filters. The first and second outer filters have identical configurations. Each of the first and second outer filters may be provided with an overflow passageway adjacent the mid-portion of the top edges thereof. The first and second outer filters, inner filter, and rigid rib member are attached together to form the filter assembly. At least two strap openings extend through the filter assembly to permit a flexible or rigid strap to pass therethrough for attaching the assembly to the curb grate of a catch basin.

7 Claims, 2 Drawing Sheets

CATCH BASIN CURB INLET FILTER ASSEMBLY

CROSS-REFERENCE TO RELATED APPLICATIONS

This application claims the benefit of U.S. Provisional Application No. 60/188,286, filed Mar. 7, 2000.

BACKGROUND OF THE INVENTION

This invention relates to a catch basin curb inlet filter assembly.

During and after a rainstorm rainwater typically runs into gutters located on the sides of a roadway, and through a vertical barred grate located in the curb at the entrance to a storm sewer catch basin. The rainwater running down the streets and gutters picks up all sorts of debris which can clog the entrance grate and/or catch basin.

It would be desirable to prevent such debris from clogging the entrance grate or entering the catch basin.

SUMMARY OF THE INVENTION

It is an object of the present invention to provide a filter assembly that can be attached to the front of the curb grate entrance to a storm water catch basin.

The filter assembly of the present invention comprises first and second outer filters, an inner filter located between the first and second outer filters and attached thereto adjacent the lower longitudinal edges thereof, and a rigid rib member located between the first and second outer filters.

The first and second outer filters are identical in construction. Each has first and second ends, a bottom edge, and a top edge. Preferably an overflow passageway is located adjacent the mid-portion of the top edge.

A plurality of fastener openings extend through at least the first outer filter and the rigid rib member, the fastener openings being in alignment. A plurality of fasteners extend through the fastener openings and attach the rigid rib member to the first outer filter.

At least two spaced apart strap openings extend through the first and second outer filters and, optionally, through the rigid rib member.

DESCRIPTION OF PREFERRED EMBODIMENTS

Figure 1:
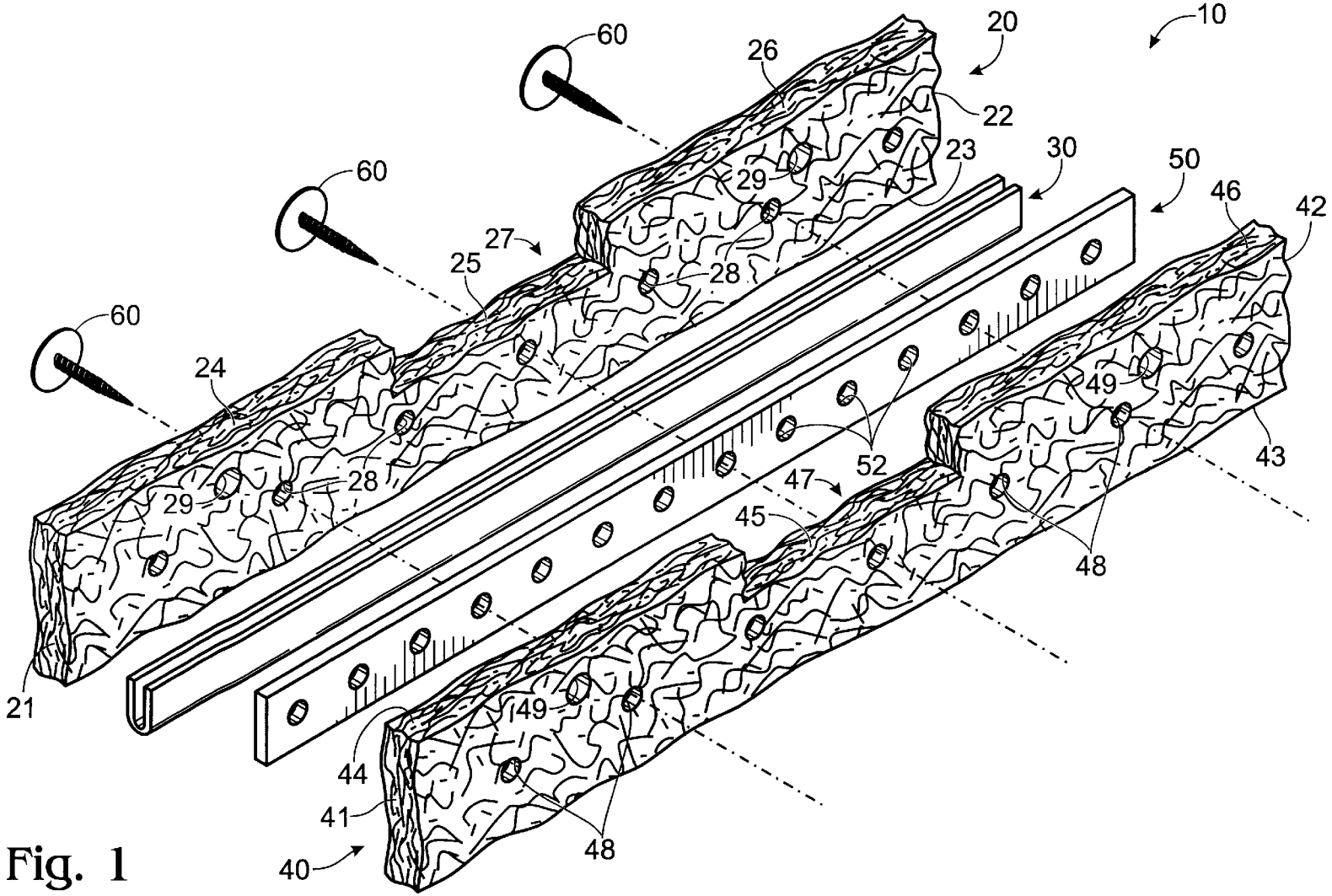
FIG. 1 is an exploded, rear perspective view of the filter assembly of the present invention.

The filter assembly 10 is comprised of first outer filter member 20, inner filter member 30, second outer filter member 40, and a rigid rib member 50.

First outer filter member 20 is a generally rectangular member having ends 21 and 22, bottom edge 23, and top edges 24, 25, and 26. Top edges 24 and 26 are coplanar. Top edge 25 is, preferably, recessed from the plane of top edges 24 and 26 to provide an overflow passageway (spillway) 27.

A plurality of fastener holes 28 extend through first outer filter member 20 in the lower half thereof. At least two spaced apart strap openings 29 also extend through first outer filter member 20 at about the mid-point between the bottom and top edges 23 and 24, and between bottom and top edges 23 and 26.

First outer filter member 20 can be made of various materials. One suitable material is "Poly Flo" made by Aero-Flo Industries, Inc. Environmentally friendly biodegradable materials may be used, including agricultural waste products such as ground nut shells or straw.

Figure 2:
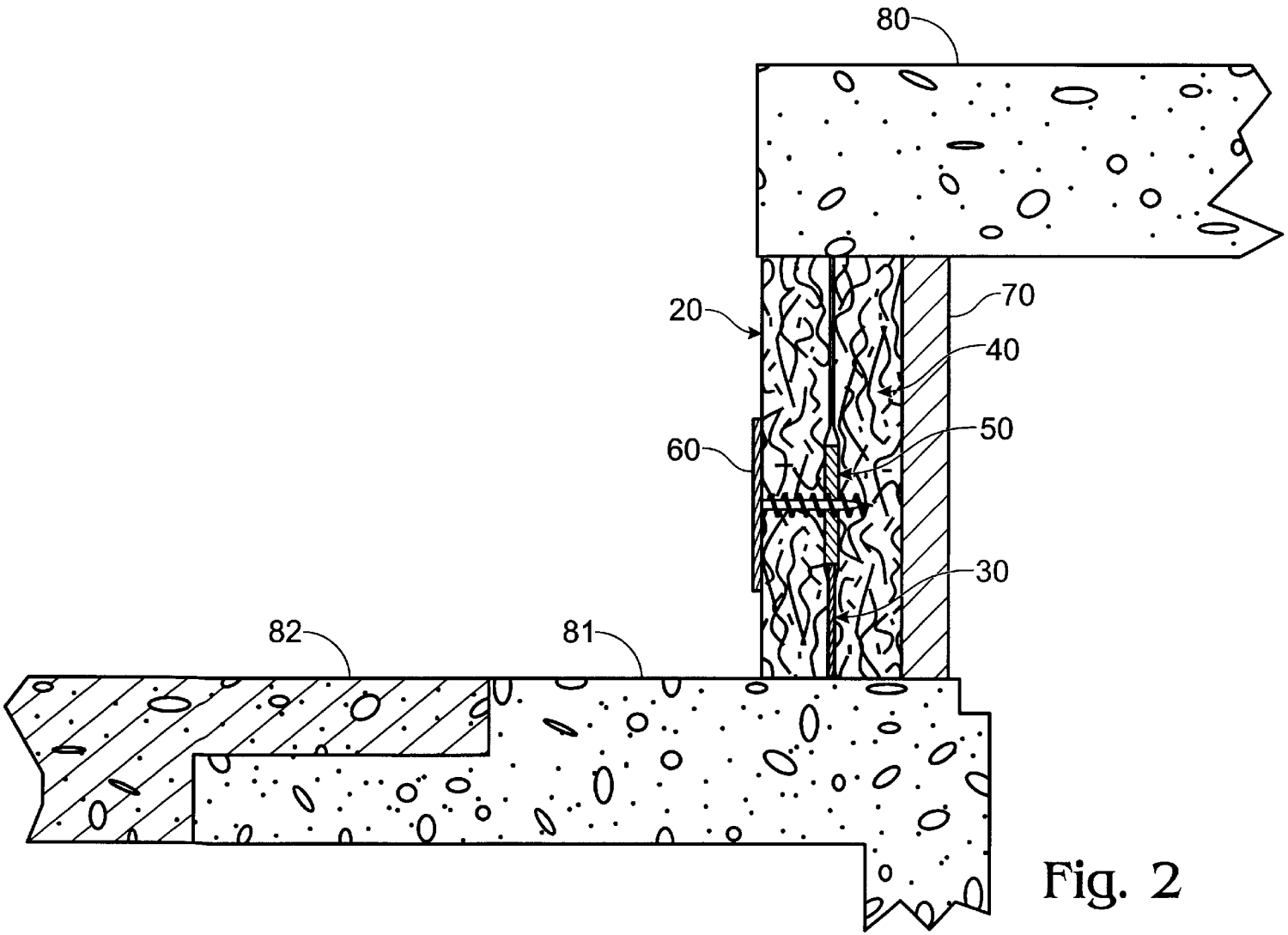
FIG. 2 is a cross-sectional side view of the filter assembly of the present invention, shown in place at a catch basin curb inlet.

Inner filter member 30 is generally U-shaped, i.e., is a single piece of material folded back on itself, and is located between the lower longitudinal edges of first and second outer filter members 20 and 40, extending slightly therebelow as best seen in FIG. 2.

Inner filter member 30 is preferably a flexible geotextile material, such as Amoco 4545 manufactured by Amoco Fabrics and Fibers Company. This material has a permeativity of 2.1 sec. when measured in accordance with ASTM Test Method D-4491. This filter material has a finer mesh than the filter material forming first outer filter 20. It's purpose is to catch fine sediment that has settled to the bottom of a rainwater stream flowing down a gutter to the inlet of a catch basin.

Second outer filter member 40 has substantially the same configuration, and is preferably made of the same material, as inner filter member 20. That is, outer filter member 40 is a generally rectangular member having ends 41 and 42, bottom edge 43, and top edges 44, 45, and 46. Top edges 44 and 46 are coplanar. Top edge 45 is, preferably, recessed from the plane of top edges 44 and 46 to provide an overflow passageway (spillway) 47.

In the preferred embodiment illustrated, a single spillway formed by overflow passageways 27 and 47 is shown positioned in the middle of outer filter members 20 and 40, adjacent the upper longitudinal edges thereof. However, the spillway could be located adjacent one of the ends of the outer filter members 20 and 40.

Alternatively, two or more spillways could be formed at various locations adjacent the top longitudinal edges of outer filter members 20 and 40, it only being required that at least one such spillway be formed in the preferred embodiment.

The spillway or spillways could be located below the upper longitudinal edges of outer filter members 20 and 40, but they are desirably located in the upper half of filter assembly 10, above rigid rib member 50.

Although it is preferred to provide a spillway formed by overflow passageway 27 in first outer filter member 20 and overflow passageway 47 in the second outer filter member 40 in order to allow water to flow into the sewer in the event the filter assembly 10 becomes clogged, overflow passageways 27 and 47 may be omitted for uses where it is essential that no unfiltered water be allowed to pass into the sewer.

Where overflow passageways 27 and 47 are present in the filter assembly 10, it has been found to be desirable to provide a waterproof wrap (not shown) over the tops of the passageways. The wrap can be attached to the faces of the first and second outer filters 20 and 40 adjacent the tops of overflow passageways 27 and 47, such as by stapling or sewing. A suitable material for such a wrap is Amoco 2002.

A plurality of fastener holes 48 may, optionally, extend through outer filter member 40. At least two strap openings 49 also extend through outer filter member 40 at about the mid-point between the bottom and top edges 43 and 44, and between bottom and top edges 43 and 46.

When first outer filter member 20 and second outer filter member 40 are assembled together, the ends 21 and 41, ends 22 and 42, bottom edges 23 and 43, top edge 24 and 44, top edge 25 and 45, top edge 26 and 46, fastener holes 28 and 48, and strap openings 29 and 49 of both filter members are all in alignment with each other.

Rigid rib member 50 has a plurality of holes 52, some of which holes 52 are in alignment with fastener holes 28 and 48 of inner primary filter 20 and outer filter 40, respectively, and some of which holes 52 are in alignment with strap holes 29 and 49 of first and second outer filters 20 and 40. However, holes 52 that are in alignment with strap holes 29 and 49 may be omitted, and strap holes 29 and 49 located along first and second outer filter members positioned above the location of the upper edge of rigid rib member 50.

Rigid rib member 50 is preferably made of wood but can be made of other rigid materials, such as steel, aluminum, plastic, etc.

In assembling filter assembly 10, inner filter member 30 is placed against the inner planar surface of first outer filter 20 along the lower longitudinal portion thereof and with at least a portion of the inner filter 30 extending below the lower edge 23. The lower edge of rigid rib member 50 is placed adjacent the top edge of inner filter member 30 and against the inner planar surface of first outer filter member 20. Rigid rib member 50 is positioned over the row of fastener holes 28 so that some of the holes 52 of rigid rib member 50 are in alignment with fastener holes 28. Fastener members 60 are inserted through fastener holes 28 and holes 52 in rigid rib member 50.

Fastener members 60 are preferably beveled screws ("Hood" fasteners) which screw into rigid rib member 50 and tightly secure it against first outer filter 20. However, fastener members 60 can be bolts to which nuts are attached against rigid rib member 50, or other fastening devices.

Second outer filter 40 is then placed on top of first outer filter 20 with their inner planar faces in abutment and their ends, longitudinal edges and spillways in juxtaposition. First and second outer filters 20 and 40, and inner filter 30, are then attached together.

Where the fastener members 60 only extend into or through rigid rib member 50, and not through second outer filter 40, holes 48 in second outer filter 40 may be omitted. However, it is preferable that first and second outer filter members 20 hand 40 be identical, i.e., that both have holes 28 and 48, in order to save manufacturing and assembly costs. Also, having holes 48 in second outer filter 40 allows use of fastener members, such as nuts and bolts, which extend all the way through filter assembly 10.

Regardless of whether fastener members 60 only extend as far as rigid rib member 50 or through second outer filter member 40, first outer filter member 20 and second outer filter member 40 are preferably secured to each other by stapling adjacent the upper and lower longitudinal edges thereof, with the staples adjacent the lower longitudinal edges passing through inner filter 30 to secure it in place.

Alternatively, first and second outer filters 20 and 40 and inner filter member 30 can be attached to each other by other means such as by gluing, sewing or welding.

The length and width of filter assembly 10 are adapted to allow the filter assembly 10 to fit into the curb inlet and against the bars 70 of the curb inlet grate, as shown in FIG. 2. The thickness of filter assembly 10 is such that filter assembly 10 does not extend substantially into the street adjacent the curb.

In use, either first or second outer filter member 20 or 40 may be placed against the bars 70 of the curb inlet grate of a catch basin. In FIG. 2 second outer filter member 40 is shown placed against curb inlet grate bars 70 which extend between sidewalk 80 and curb 81, adjacent roadway 82. Strap members (not shown) are passed through strap holes 29 and 49 of the first and second outer filters, respectively, and through holes 52 in rigid rib member 50 where they are in alignment with strap holes 29 and 49.

The strap members are then used to strap filter assembly 10 to the bars 70 of the curb inlet grate. The strap members can be flexible (such as "Quick Tie") or rigid (e.g., a metal rod with a hook at the grate end (for attachment to the bars 70 of the grate) and threaded at the other end to receive a washer and wing nut).

It will be obvious to those having skill in the art that changes may be made to the above-described embodiments of this invention without departing from the underlying principles thereof. The scope of the present invention should, therefore, be determined only by the following claims.

The invention claimed is:

1. A catch basin curb inlet filter assembly comprising:

first and second outer filters, each of said first and second outer filters having first and second ends, a longitudinal bottom edge, a longitudinal top edge and opposing inner and outer planar surfaces, the ends and edges of said first outer filter being in juxtaposition with the respective ends and edges of said second outer filter;

an inner filter located between said first and second outer filters adjacent the lower longitudinal edges thereof;

a rigid rib member located between said first and second outer filters above said inner filter; and means for attaching together said first and second outer filters, said inner filter and said rigid rib member.

2. The filter assembly of claim 1 wherein at least one overflow passageway extends through said first and second outer filters above said rigid rib member to form at least one spillway.

3. The filter assembly of claim 2 wherein said spillway is located in the upper half of said assembly.

4. The filter assembly of claim 2 wherein said spillway is located in the middle of said assembly, adjacent the top longitudinal edge thereof.

5. The filter assembly of claim 1 wherein said means for attaching said first and second outer filters and said inner filter member are staples.

6. The filter assembly of claim 1 including a plurality of fastening members extending through said first outer filter and through said rigid rib member to thereby attach said rigid rib member to said first outer filter.

7. A catch basin curb inlet filter assembly comprising:

first and second outer filters, each of said first and second outer filters having first and second ends, a longitudinal bottom edge, and a longitudinal top edge;

a plurality of fastener holes extending through at least said first outer filter in the lower half thereof;

an inner filter located between said first and second outer filters adjacent the lower longitudinal edges thereof;

a rigid rib member located between said first and second outer filters, said rigid rib member having a plurality of fastener holes extending therethrough and in alignment with said fastener holes of said first outer filter;

fastening means extending through said fastener holes of said first outer filter and said rigid rib member for securing said first outer filter and said rib member together; and means for attaching together said first and second outer filters and said inner filter.

* * * * *